US008308036B2

(12) United States Patent
Kato

(10) Patent No.: US 8,308,036 B2
(45) Date of Patent: Nov. 13, 2012

(54) SHEET MATERIAL FEEDING APPARATUS

(75) Inventor: Heizaburo Kato, Kikugawa (JP)

(73) Assignee: Sankyo Seisakusho Co., Tokyo (JP)

( * ) Notice: Subject to any disclaimer, the term of this patent is extended or adjusted under 35 U.S.C. 154(b) by 459 days.

(21) Appl. No.: 12/261,387

(22) Filed: Oct. 30, 2008

(65) Prior Publication Data

US 2009/0108522 A1 Apr. 30, 2009

(30) Foreign Application Priority Data

Oct. 31, 2007 (JP) ..... 2007-283367

(51) Int. Cl.
*B65H 20/04* (2006.01)
*B21D 43/09* (2006.01)

(52) U.S. Cl. ..... 226/154; 226/177; 226/181

(58) Field of Classification Search ..... 226/137, 226/154, 155, 156, 157, 177; 83/259, 261, 83/422

See application file for complete search history.

(56) References Cited

U.S. PATENT DOCUMENTS 1,978,303 A * 10/1934 Guett ..... 83/422
2,726,083 A * 12/1955 Lewis, III ..... 226/176
4,158,429 A * 6/1979 Ohmori ..... 226/34
4,415,108 A 11/1983 Katoh
4,638,990 A 1/1987 Kato
4,844,444 A * 7/1989 Kato ..... 271/268
4,869,411 A * 9/1989 Kato ..... 226/142
5,109,690 A * 5/1992 Taniguchi et al. ..... 72/206
5,197,645 A * 3/1993 Nordlof ..... 226/154
5,356,062 A * 10/1994 Kato ..... 226/31
5,720,421 A 2/1998 Gentile et al.
2003/0200877 A1 10/2003 Blei

FOREIGN PATENT DOCUMENTS

DE 3143177 5/1982

(Continued)

OTHER PUBLICATIONS

Search Report dated Sep. 8, 2011, International Application No. 097139335, Filing Date: Oct. 14, 2008 (English-language translation included. Note that translation includes inadvertent typographical errors. Specifically, JP2952537B2, JP11-169923A, and JP11285702A are listed in original Taiwanese Search Report, but are inadvertently misnumbered in the English translation.).

*Primary Examiner* — Sang Kim
*Assistant Examiner* — Scott Haugland
(74) *Attorney, Agent, or Firm* — Harness, Dickey & Pierce, P.L.C.

(57) ABSTRACT

A main roll and a sub-roll of a sheet material feeding apparatus interpose therebetween a sheet material to intermittently feed the same to a press apparatus. A roll clearance is adjusted according to a sheet thickness by displacing the main roll up and down. A release device that temporarily releases a sheet material having been interposed by the both rolls just before the sheet material is subjected to press working by the press apparatus includes a sub-roll guide that can move up and down together with the sub-roll, a rectilinear cam, and cam followers for engagement with a cam surface of the rectilinear cam, and the release device moves the rectilinear cam axially of the sub-roll in synchronism with the operation of the press apparatus to thereby displace the sub-roll up and down through the cam followers and the sub-roll guide.

10 Claims, 15 Drawing Sheets

FOREIGN PATENT DOCUMENTS

| | | |
|---|---|---|
| GB | 843799 | 8/1960 |
| JP | 63-157421 | 10/1988 |
| JP | 01-113122 | 5/1989 |
| JP | 3-57414 | 6/1991 |
| JP | 05-228560 | 9/1993 |
| JP | 11-010209 | 1/1999 |
| JP | 11-169923 A | 6/1999 |
| JP | 2952537 | 9/1999 |
| JP | 11-285702 | 10/1999 |

* cited by examiner

<AT THE TIME OF RELEASE>

<AT THE TIME OF CLAMP>

FEEDING APPARATUS
1
9
PRESS
FIRST PROCESS
SECOND PROCESS
2
9a
10A
START OF FEED
8
10a
8b
8a
10b 10c
3
10B
FEED
8b

8a
TERMINATION OF FEED

START OF RELEASE

10d
DURING RELEASE (MATERIAL POSITIONING)

10d
DURING RELEASE (MATERIAL WORKING)
8c
LOWER DEAD CENTER

DISCHARGE OF PILOT PIN
START OF CLAMP
8c 100
101

SHEET MATERIAL FEEDING APPARATUS

CROSS-REFERENCE TO RELATED APPLICATIONS

This application claims the benefit of Japanese Patent Application No. 2007-283367, filed on Oct. 31, 2007, the contents of which are incorporated herein by reference in its entirety.

BACKGROUND OF THE INVENTION

The present invention relates to a sheet material feeding apparatus that intermittently feeds a sheet material a predetermined quantity by a predetermined quantity to a press apparatus, and more particularly to a sheet material feeding apparatus suited to feeding of a sheet material, which is used for manufacturing small-sized parts used in information associated equipment such as personal computers, etc., to a press apparatus at high speed with high accuracy.

Conventionally, there are known sheet material feeding apparatuses comprising a pair of upper and lower rolls that interpose therebetween and feed intermittently a sheet material to a press apparatus, a roll clearance adjusting device that adjusts a clearance between the both rolls according to the thickness of a sheet material, and a release device that temporarily releases a sheet material, having been interposed by the both rolls, just before a sheet material fed to the press apparatus is subjected to press working, the pair of rolls comprising a main roll driven by a drive motor and a sub-roll driven through a sheet material by the main roll (see, for example, U.S. Pat. No. 5,720,421).

Also, there is known a sheet material feeding apparatus (see, for example, U.S. Pat. No. 5,720,421), in which a servomotor is used as a drive motor for driving of a main roll, and a sheet material feeding apparatus (see, for example, JP-U-3-57414), in which a drive motor having an annular stator and an annular rotor is constituted as a main roll.

The release device performs the function of temporarily releasing a sheet material in synchronism with the operation of a press apparatus, that is, the sheet-material releasing function. That is, there are some metal mold devices for press apparatuses, in which a pilot pin directed downward is protrusively provided on an upper metal mold and just before the upper metal mold and a lower metal mold are caused to butt against each other to permit press working, the pilot pin is inserted into a positioning hole beforehand formed on a sheet material to enable positioning the sheet material relative to the metal mold device with high accuracy. In order to position the sheet material with the use of the pilot pin, it is required that a sheet material feeding apparatus releases the sheet material from the pair of rolls at the time of positioning. The release device is provided to produce such function.

The U.S. Pat. No. 5,720,421 describes a construction of the release device, which comprises a wedge member having an inclined surface inclined at a predetermined angle and a follower connected to a sub-roll to engage with the inclined surface of the wedge member and in which the wedge member is moved axially of the sub-roll by a drive device to displace the sub-roll up and down through the follower, thereby generating the sheet-material releasing function.

The construction having the wedge member and the follower also generates the function of adjusting a clearance between the both rolls according to the thickness of a sheet material, that is, the roll clearance adjusting function.

In the release device described in the U.S. Pat. No. 5,720,421, the follower engages with the inclined surface, which is inclined at a predetermined angle, and when the wedge member is moved axially of the sub-roll, the follower in engagement with the inclined surface of the wedge member is displaced up and down by a magnitude in proportion to shift of the wedge member and the sub-roll is displaced up and down by a magnitude corresponding to the displacement of the follower. That is, horizontal shift of the wedge member and vertical displacement of the sub-roll are linearly related to each other. Accordingly, it is difficult to perform control so as to smooth actions at the start (that is, when the sub-roll begins a vertical displacement) and at the time of stoppage (that is, when the sub-roll stops a vertical displacement) and there is a fear that vibrations occur to lead to degradation in accuracy of feeding, in particular, when the sheet material feeding apparatus is operated at high speed.

Also, that construction, in which the wedge member and the follower causes vertical displacement of the sub-roll, is both one that generates the sheet-material releasing function and one that generates the roll clearance adjusting function and by operating the same drive device, the respective functions are generated, but there is a fear that it becomes difficult to appropriately control the drive device so as to generate the both functions appropriately.

For example, in order to enable feeding sheet materials having various thicknesses, let assume that the roll clearance adjusting function is required to generate a vertical displacement of a sub-roll within the range of 1 mm to 5 mm. Even in such case, it suffices that a vertical displacement of a sub-roll required to generate the sheet-material releasing function be in the order of 0.05 mm to 0.1 mm. In this manner, there is usually a large difference between the range of displacement of a sub-roll required to generate the roll clearance adjusting function and the range of displacement of a sub-roll required to generate the sheet-material releasing function. Generally, in the case where a distance of displacement is large, it is required to increase a displacement speed and in the case where a distance of displacement is small, it is required to make a displacement accurate rather than to increase a displacement speed, but it is difficult to appropriately control a single drive device so as to meet different demands in this manner.

SUMMARY OF THE INVENTION

It is an object of the invention to provide a sheet material feeding apparatus that dissolves the problem in the related art and can appropriately generate the sheet-material releasing function and the roll clearance adjusting function.

In order to solve such problem, the sheet material feeding apparatus according to the invention has a feature that the roll clearance adjusting device displaces the main roll up and down to adjust a clearance between the both rolls, and the release device includes a sub-roll guide that rotatably supports the sub-roll and can move up and down together with the sub-roll, a rectilinear cam that is movable axially of the sub-roll, a cam follower mounted to the sub-roll guide to engage with a cam surface of the rectilinear cam, and a control device that moves the rectilinear cam in synchronism with the operation of the press apparatus to move the sub-roll up and down through the cam follower and the sub-roll guide.

The sheet material feeding apparatus according to the invention generates a sheet-material releasing function by moving the rectilinear cam in synchronism with the operation of the press apparatus to displace the sub-roll up and down through the cam follower and the sub-roll guide. A vertical displacement of the sub-roll corresponding to a vertical displacement of the cam follower is controlled by a shape of a cam surface of the rectilinear cam, with which the cam follower engages. Accordingly, an appropriate design of the shape of the cam surface makes it possible to smooth operations at the start (when the sub-roll begins a vertical displacement) and at the time of stoppage (when the sub-roll stops a vertical displacement).

Also, the roll clearance adjusting device displaces the main roll up and down to generate the roll clearance adjusting function while the release device displaces the sub-roll up and down to generate the sheet-material releasing function. In this manner, since the release device is configured to generate only the sheet-material releasing function irrespective of the roll clearance adjusting function, it becomes very easy to design the shape of the cam surface of the rectilinear cam so as to preferably generate the sheet-material releasing function, or the like. Also, it is possible to appropriately set conditions to design the roll clearance adjusting device irrespective of the sheet-material releasing function.

In an embodiment of the invention, the roll clearance adjusting device comprises an eccentric flange mounted rotatably in a housing of the sheet material feeding apparatus and including a cylindrical-shaped, outer peripheral surface centered on an eccentric axis off-centered relative to an axis of the main roll and a cylindrical-shaped, inner peripheral surface in the coaxial relationship with the axis of the main roll, the both axial ends of the main roll are mounted rotatably in the housing with the eccentric flange therebetween, and the main roll is displaced up and down by rotating the eccentric flange relative to the housing about the eccentric axis.

In a further embodiment of the invention, an eccentric-flange driving device for rotational driving of the eccentric flange is provided on the eccentric flange.

For example, the eccentric-flange driving device includes an eccentric-flange drive motor mounted to one axial end of the eccentric flange, a swinging arm mounted to a motor shaft of the eccentric-flange drive motor and provided in a recess on a wall portion of the eccentric flange, and a roller follower provided protrusively at a tip end of the swinging arm to be able to roll and to engage with a guide groove provided on a wall portion of a housing of the sheet material feeding apparatus, and when the motor shaft of the eccentric-flange drive motor is rotationally driven to swing the swinging arm, the eccentric flange is rotated through the roller follower and the guide groove.

DESCRIPTION OF THE PREFERRED EMBODIMENTS (Fundamental Operation of Sheet Material Feeding Apparatus)

Figure 1:
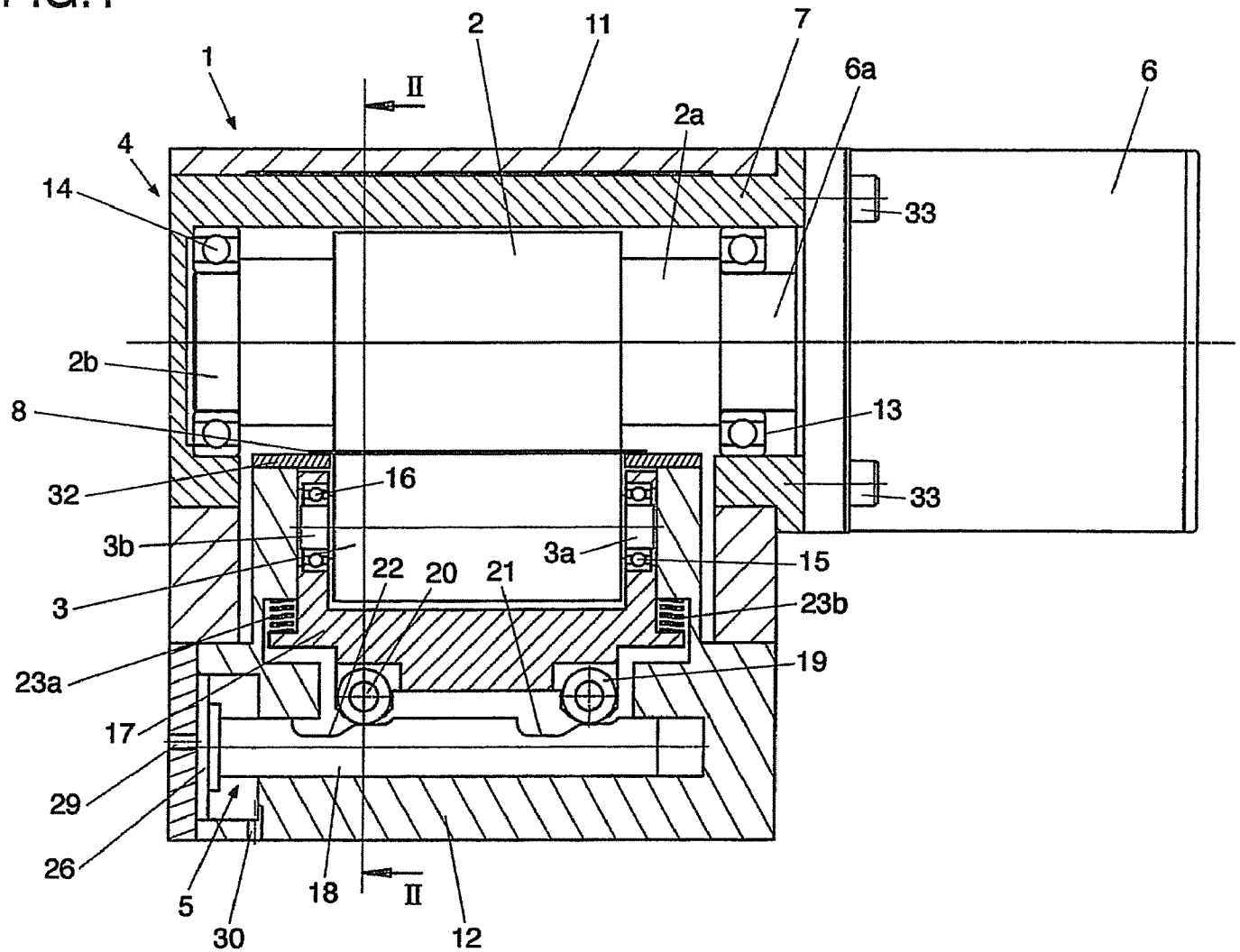
FIG. 1 is an axial, cross sectional view showing a sheet material feeding apparatus according to Embodiment 1 of the invention.
Figure 2:
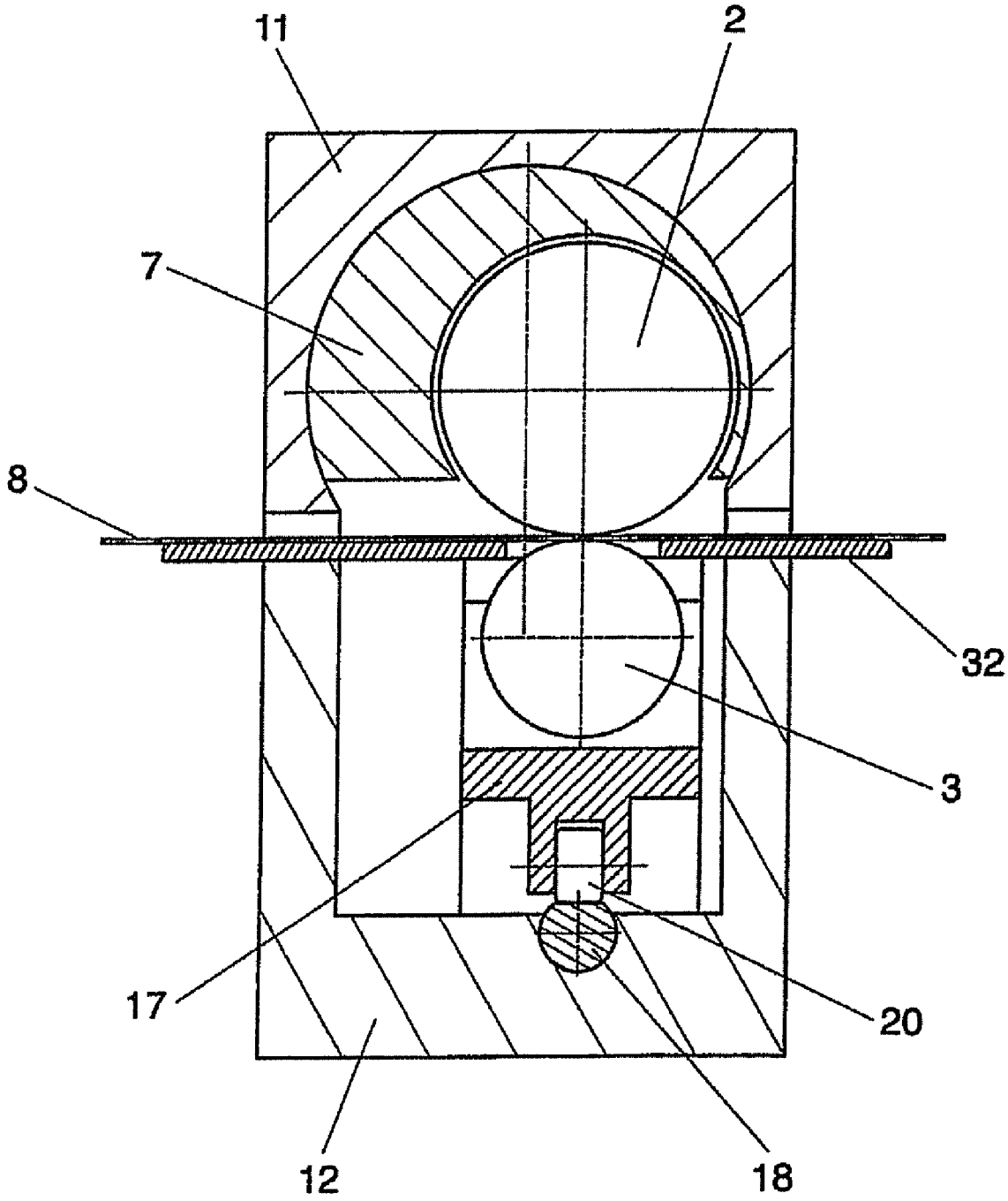
FIG. 2 is a cross sectional view as viewed in an arrow direction II-II in FIG. 1.

A sheet material feeding apparatus 1, according to Embodiment 1, shown in FIGS. 1 and 2 comprises a pair of upper and lower rolls, that is, a main roll 2 and a sub-roll 3, by which a sheet material 8 is interposed, and the material is fed to a press apparatus in an intermittent feeding action. While the specific construction of respective parts of the apparatus will be described later, the fundamental operation of the sheet material feeding apparatus 1 will be first described with reference to FIG. 7.

Figures 7A, 7B, 7C, 7D, 7E, 7F, 7G:
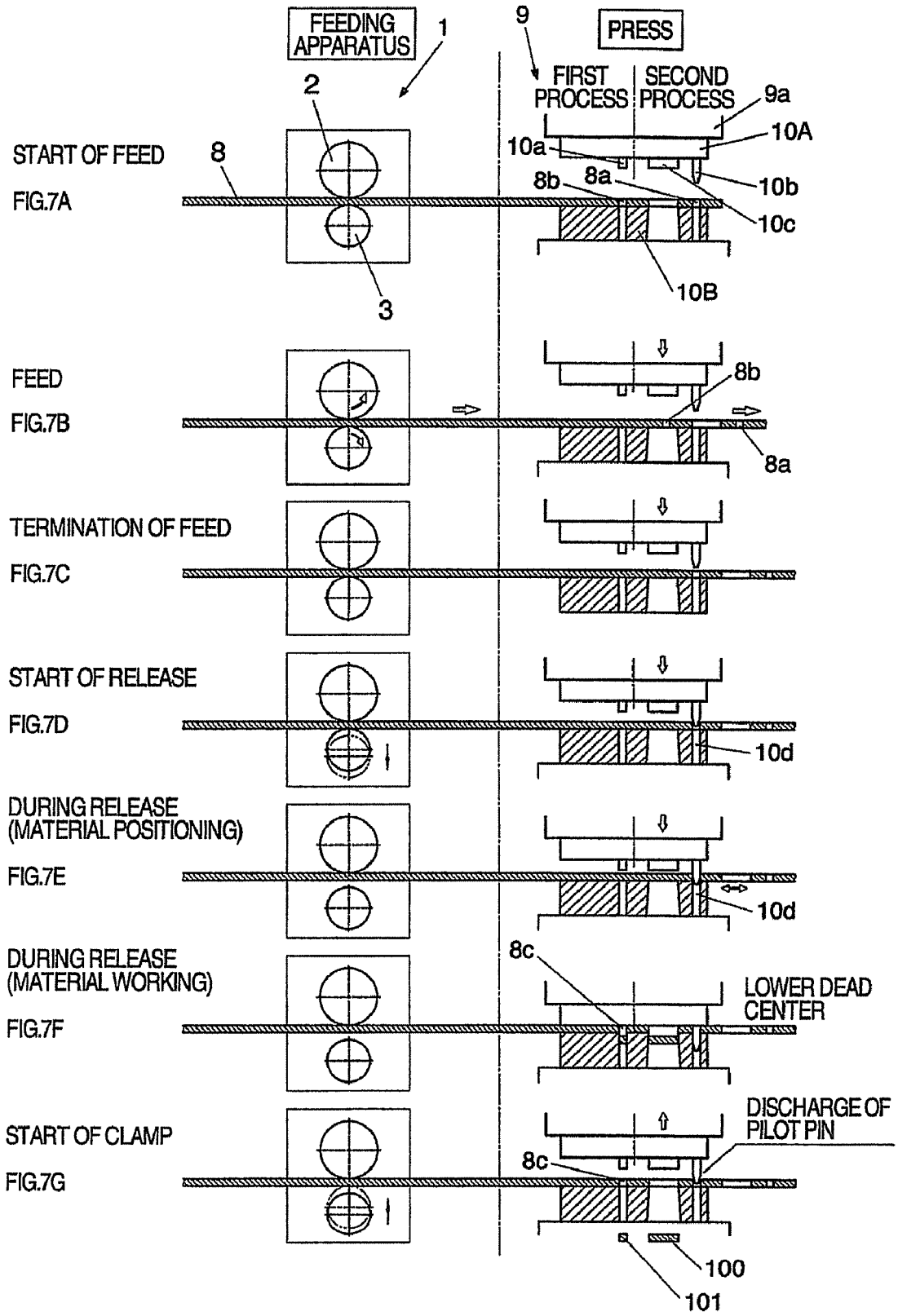
FIGS. 7A, 7B, 7C, 7D, 7E, 7F, and 7G are schematic views illustrating the relationship between the feeding action of the sheet material feeding apparatus and the action of a press apparatus.

FIG. 7A shows a state, in which a punching punch 10*a* forms a positioning hole 8*a* in the sheet material 8 fed to the press apparatus 9 by the sheet material feeding apparatus 1 (first process), then the sheet material 8 is further fed by the sheet material feeding apparatus 1, press working, that is, punching working by a blanking punch 10*c* (second process) and formation of a positioning hole 8*b* by the punching punch 10*a* are completed, and a slider 9*a* of the press apparatus 9 rises.

In a state shown in FIG. 7A, the sheet material feeding apparatus 1 is stationary having the sheet material 8 interposed by the main roll 2 and the sub-roll 3. From this state, the main roll 2 is rotationally driven a predetermined angle as shown in FIG. 7B whereby the sub-roll 3 is rotated through the sheet material 8 to feed the sheet material 8 rightward in the figure. In this manner, the sheet material 8 interposed by the both rolls is fed to the press apparatus 9. Subsequently, as shown in FIG. 7C, the both rolls become stationary, at which time the slider 9*a* with an upper metal mold 10A mounted to an underside thereof begins to descend toward a lower metal mold 10B.

Thereafter, as shown in FIG. 7D, the sub-roll 3 is displaced downward and the both rolls release the sheet material 8, in which state the slider 9*a* of the press apparatus 9 descends further as shown in FIGS. 7D and 7E and a pilot pin 10*b* provided on the upper metal mold 10A passes through the hole 8*b* of the sheet material 8 to be inserted into a receiving hole 10*d* of the lower metal mold 10B. In this manner, the sheet material 8 is positioned highly accurately between the upper metal mold 10A and the lower metal mold 10B.

Subsequently, as shown in FIG. 7F, the slider 9*a* descends further, the blanking punch 10*c* of the upper metal mold 10A punches the sheet material 8, and the punching punch 10*a* forms a positioning hole 8*c* on the sheet material. Thereafter, as shown in FIG. 7G, the slider 9*a* ascends and the sub-roll 3 is displaced upward to bring about a state, in which the both rolls interpose the sheet material 8.

By repeating a series of operations (A) to (G), the sheet material feeding apparatus 1 intermittently feeds the sheet material 8 to the press apparatus 9 (the upper metal mold 10A and the lower metal mold 10B) and the press apparatus 9 performs press working on the sheet material as fed.

In addition, the reference numeral 100 in FIG. 7G denotes a product subjected to press working and 101 denotes punched scrap when the hole 8*c* is formed.

As apparent from the above descriptions, the both rolls release the sheet material temporarily in states shown in FIGS. 7D, 7E, and 7F, during which the sheet material is positioned in the press apparatus 9 by inserting the pilot pin 10*b* into the hole 8*b* beforehand formed on the sheet material.

(Main Roll and Sub-Roll)

As shown in FIG. 1, the main roll 2 is rotationally driven intermittently by a drive motor 6 such as servomotor or the like and the sub-roll 3 is rotated through the sheet material 8 by the main roll 2. The drive motor 6 is fixed to one end of an eccentric flange 7, described late in detail, by bolts 33 and can be rotated together with the eccentric flange 7 when the eccentric flange 7 is rotated. As shown in FIGS. 1 and 2, a housing of the sheet material feeding apparatus 1 includes a first housing portion 11 accommodating therein the main roll 2 and the eccentric flange 7 and a second housing portion 12 accommodating therein the sub-roll 3 and a sub-roll guide 17 described late in detail. The first housing portion 11 and the second housing portion 12 are assembled integrally. One end 2*a* of the main roll 2 is connected to a motor shaft 6*a* of the drive motor 6, the motor shaft 6*a* being mounted rotatably in the eccentric flange 7 with a bearing member 13 therebetween. The other end 2*b* of the main roll 2 is mounted rotatably in the eccentric flange 7 with a bearing member 14 therebetween. Both ends 3*a*, 3*b* of the sub-roll 3, respectively, are supported rotatably on the sub-roll guide 17 with bearing members 15, 16 therebetween. In addition, the reference numeral 32 in FIGS. 1 and 2 denotes a sheet material guide.

(Construction and Operation of Release Device)

Figure 3B:
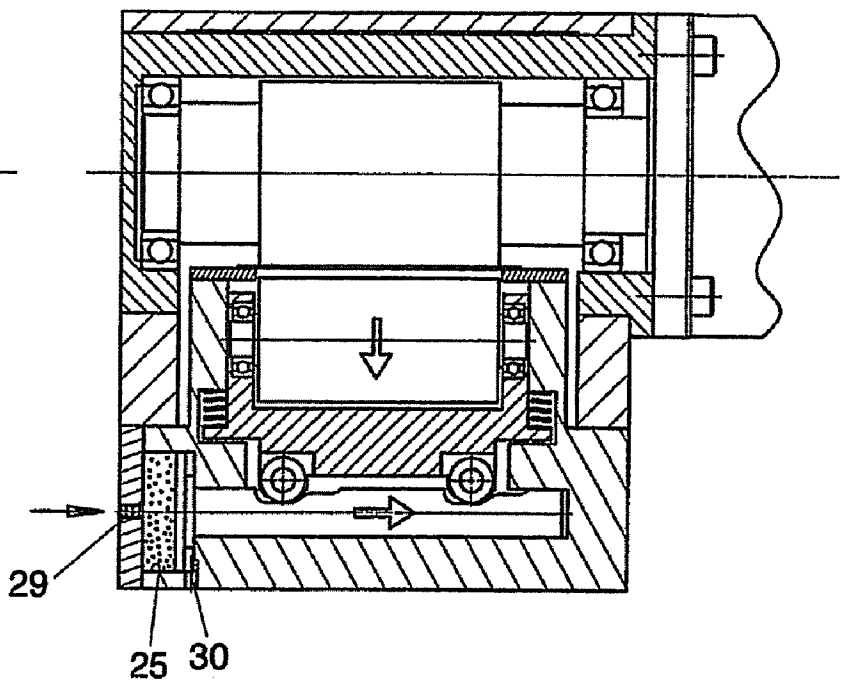
FIGS. 3A and 3B are cross sectional views illustrating the operation of a release device of the sheet material feeding apparatus according to Embodiment 1.
Figure 3A:
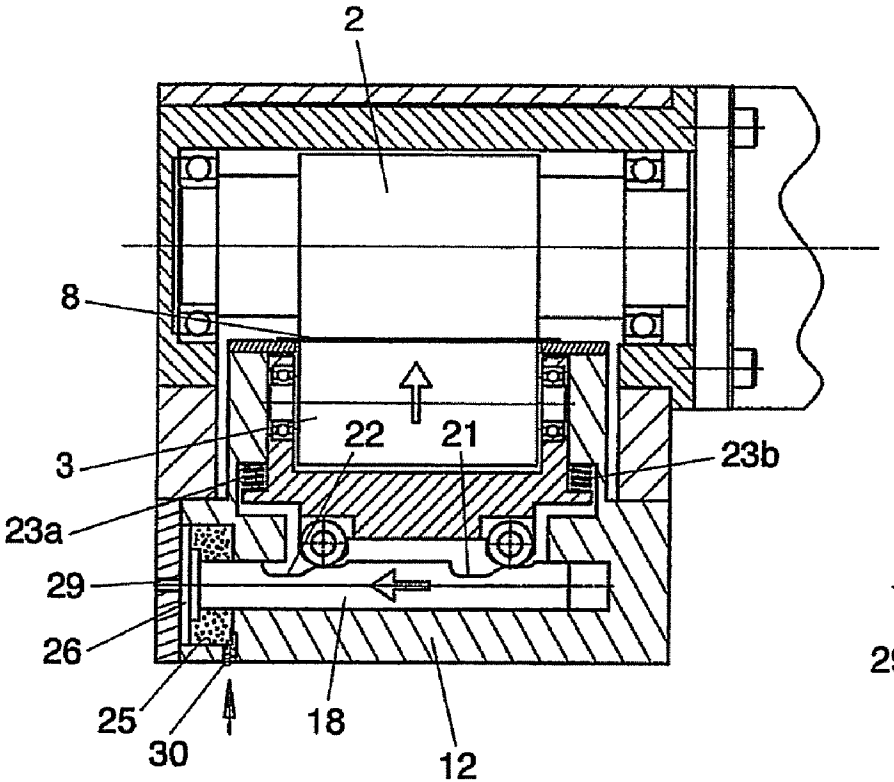
Figure 4:
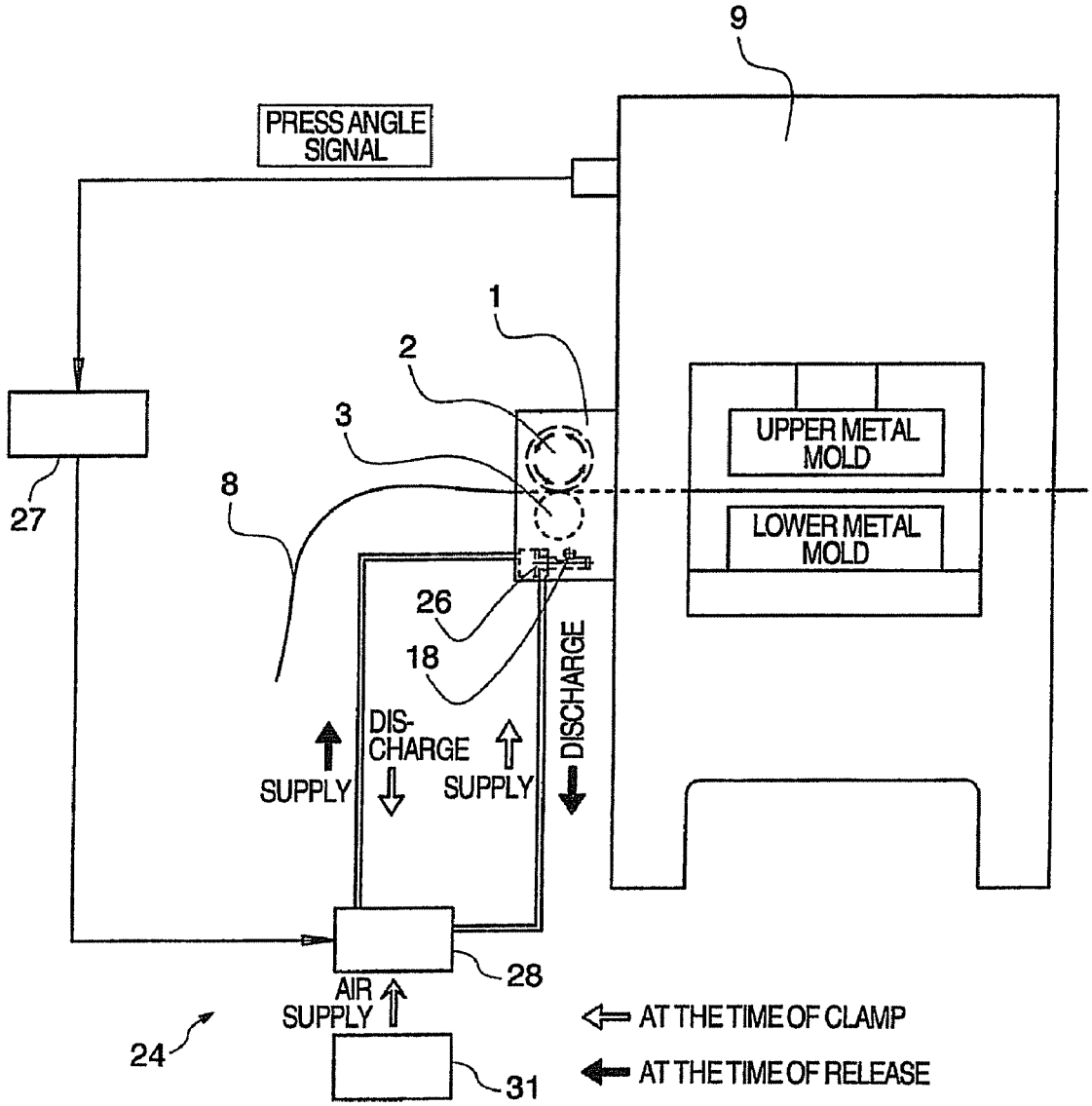
FIG. 4 is a view illustrating a control device that controls the release device.

A release device 5 comprises the sub-roll guide 17 rotatably supporting the both ends 3*a*, 3*b* of the sub-roll 3 with the bearing members 15, 16 therebetween, a rectilinear cam 18 movable axially of the sub-roll 3, and a control device 24 shown clearly in, especially, FIGS. 3 and 4.

The sub-roll guide 17 is accommodated in the second housing portion 12 to be able to move up and down together with the sub-roll 3 and biased downward by elastic members 23*a*, 23*b*. Cam followers 19, 20 are mounted to a lower end of the sub-roll guide 17 to be able to roll, the cam followers 19, 20 engaging with cam surfaces 21, 22 of the rectilinear cam 18. In Embodiment 1, the cam surfaces 21, 22 are formed in two locations spaced a predetermined distance in a longitudinal direction of the rectilinear cam 18 and the cam followers 19, 20 engage one by one with the cam surfaces 21, 22.

As shown in FIGS. 3 and 4, the control device 24 includes a cylinder 25 provided in the second housing portion 12 and a piston 26 accommodated in the cylinder 25 to be able to reciprocate and connected to the rectilinear cam 18. Also, formed on the second housing portion 12 are a first port 29 communicated to a portion of the cylinder 25 positioned on one side of the piston 26 and a second port 30 communicated to a portion of the cylinder 25 positioned on the other side of the piston 26.

As shown in FIG. 4, the control device 24 responds to a press angle signal from the press apparatus 9 to cause a controller 27 to switch a solenoid 28, thus controlling supplying of an air to the cylinder 25 from an air source 31.

That is, when the sheet material is interposed and clamped by the both rolls, the control device 24 supplies an air to the cylinder 25 through the second port 30 as shown in FIG. 3A to move the rectilinear cam 18 leftward together with the piston 26 and to discharge an air from the cylinder 25 through the first port 29 according to movements thereof. Movements of the rectilinear cam 18 engage the cam followers 19, 20 with upwardly raised portions of the cam surfaces 21, 22 of the rectilinear cam 18. Accordingly, the sub-roll guide 17 and the sub-roll are displaced upward against the elastic forces of the elastic members 23*a*, 23*b* with the cam followers 19, 20 therebetween and so the sheet material 8 is interposed between the both rolls.

When the sheet material is to be released, the control device 24 supplies an air to the cylinder 25 through the first port 29 as shown in FIG. 3B to move the sheet material 8 rightward together with the piston 26 and to discharge an air from the cylinder 25 through the second port 30 according to movements thereof. Movements of the rectilinear cam 18 engage the cam followers 19, 20 with downwardly dented portions of the cam surfaces 21, 22 of the rectilinear cam 18. Accordingly, the sub-roll guide 17 and the sub-roll are displaced downward while being pushed downward by the elastic members 23*a*, 23*b* with the cam followers 19, 20 therebetween and the sheet material 8 having been interposed between the both rolls is released thereby.

(Construction and Operation of Roll Clearance Adjusting Device)

A roll clearance adjusting device 4 is constructed so that the main roll 2 is displaced up and down to adjust a clearance between the both rolls.

Figure 5:
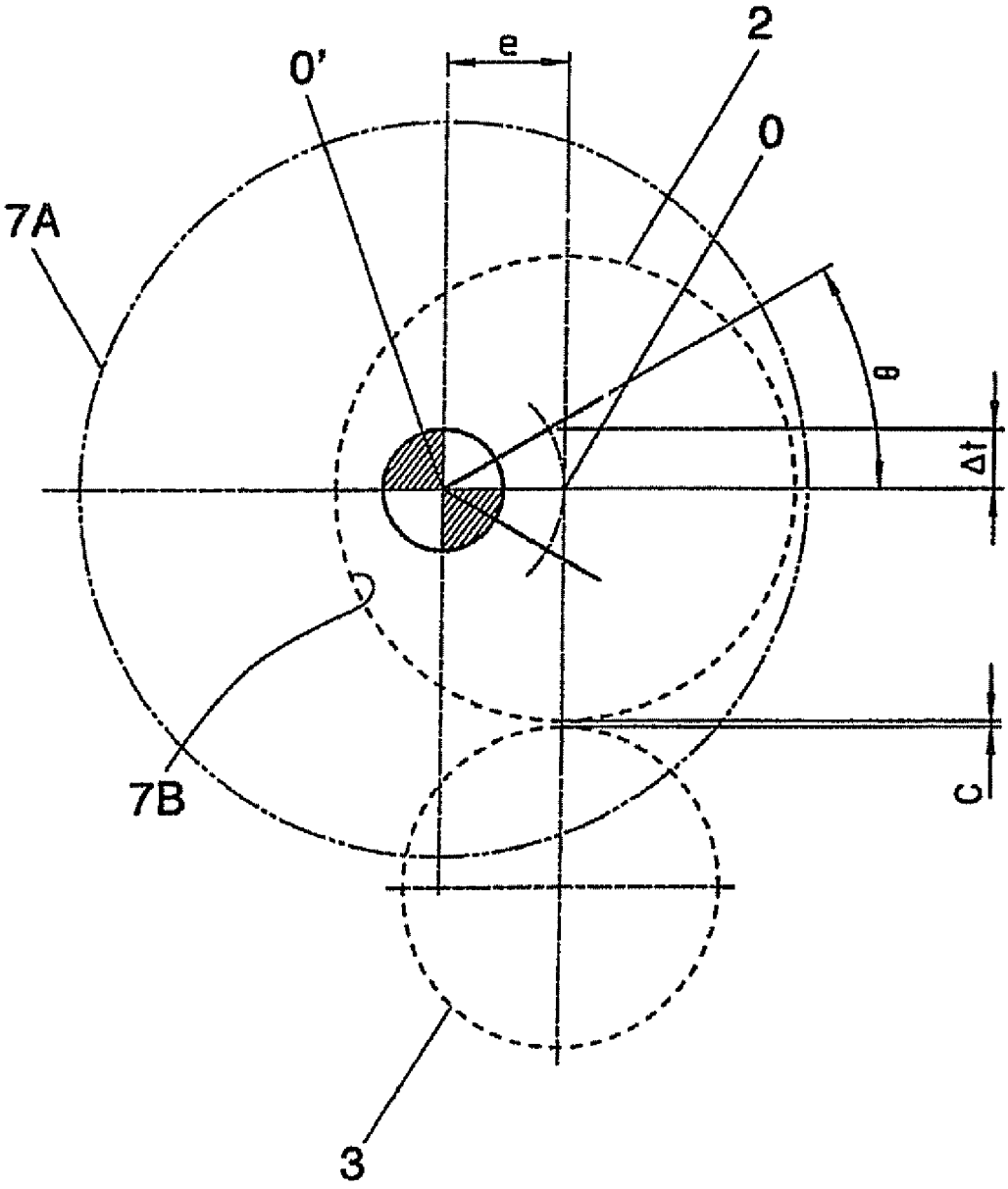
FIG. 5 is a view illustrating an eccentric flange provided on the sheet material feeding apparatus.

As shown in FIGS. 1 and 5, the roll clearance adjusting device 4 comprises the eccentric flange 7 mounted rotatably in the first housing portion 11 to surround the main roll 2. The both ends 2*a*, 2*b* of the main roll 2 are mounted in the first housing portion 11 with the bearing members 13, 14 and the eccentric flange 7 therebetween. The eccentric flange 7 includes a cylindrical-shaped, outer peripheral surface 7A centered on an eccentric axis O' off-centered relative to an axis O of the main roll 2 by a distance indicated by e in FIG. 5 and a cylindrical-shaped, inner peripheral surface 7B in the coaxial relationship with the axis O of the main roll 2.

Accordingly, when the eccentric flange 7 is rotated an angle θ relative to the first housing portion 11 about an eccentric axis O', the main roll 2 is displaced up and down by a magnitude indicated by Δt whereby it is possible to adjust a clearance C between the both rolls according to the thickness of the sheet material. The relationship among the vertical displacement Δt of the main roll 2, the distance e of eccentricity of the axis O' relative to the axis O, and a rotating angle θ of the eccentric flange 7 is as follows.

$$\Delta t = e \cdot \mathrm{SIN}\ \theta$$

It suffices that the eccentric flange 7 in Embodiment 1 be rotated an appropriate angle relative to the first housing portion 11 by suitable means to adjust a clearance C between the both rolls and be fixed in a position rotated by the suitable means after the adjustment.

In Embodiment 1, an upper roll comprises the main roll 2 driven by the drive motor and a lower roll comprises the sub-roll 3 but it is of course possible that a lower roll be made a main roll driven by a drive motor and an upper roll be made a sub-roll.

Effect of Embodiment 1

Figure 6A:
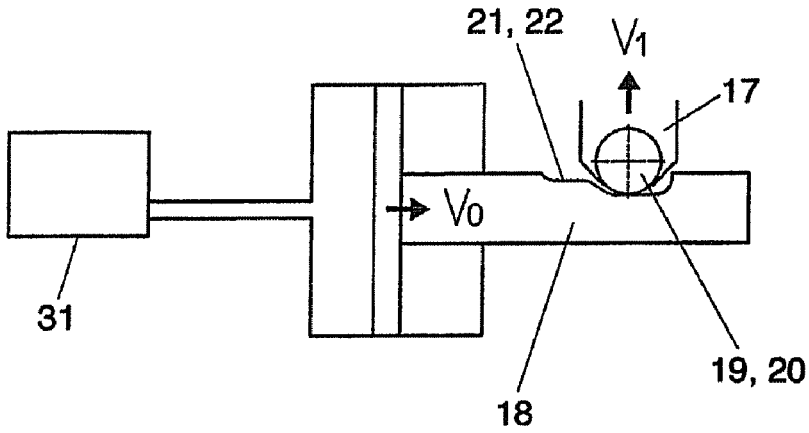
FIGS. 6A, 6B, and 6C are views illustrating meritorious effects produced by the use of a rectilinear cam.
Figure 6B:
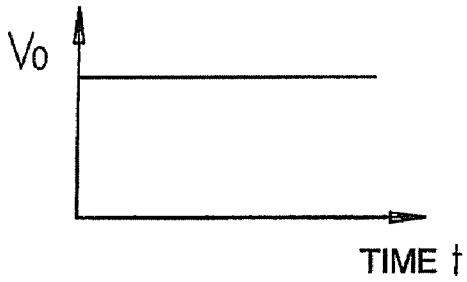
Figure 6C:
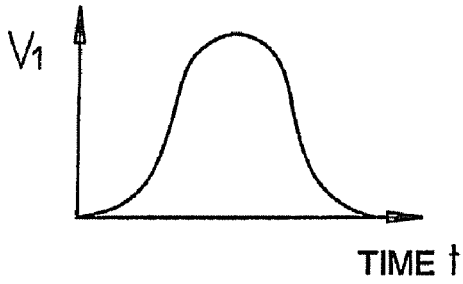

As shown in FIG. 6A, according to Embodiment 1, horizontal movement of the rectilinear cam 18 is converted into vertical displacement of the sub-roll 3 through the medium of the cam followers 19, 20 and the sub-roll guide 17. Here, where $V_0$ denotes a traveling speed of the rectilinear cam 18 in a horizontal direction and $V_1$ denotes a traveling speed of the cam followers 19, 20 in a vertical direction, the traveling speed $V_0$ of the rectilinear cam 18 is always constant over a period of time from the start of movement to the stoppage of movement and the relationship between the traveling speed $V_0$ and time t is as shown in FIG. 6B. Accordingly, when vertical displacement of the sub-roll 3 is made at a speed in proportion to the traveling speed of the rectilinear cam 18, a great impact is caused at the start (vertical displacement of the sub-roll begins) and at the stoppage (vertical displacement of the sub-roll stops). According to Embodiment 1, since vertical displacements of the cam followers 19, 20 are made through the cam surfaces 21, 22 of the rectilinear cam 18, however, an appropriate design of shapes of the cam surfaces 21, 22 makes it possible to configure the relationship between the traveling speed $V_1$ of the cam followers 19, 20, that is, the sub-roll and time t in a manner shown in FIG. 6C, thus enabling smoothing operations at the start and at the stoppage to eliminate generation of impulse and vibrations in operation.

Also, the roll clearance adjusting device 4 displaces the main roll 2 vertically to generate the roll clearance adjusting function while the release device 5 displaces the sub-roll 3 vertically to generate the sheet-material releasing function. In this manner, since the release device is configured to generate only the sheet-material releasing function irrespective or independently of the roll clearance adjusting function, it becomes very easy to design the shape of the cam surfaces of the rectilinear cam so as to preferably generate the sheet-material releasing function, or the like. Also, it is possible to appropriately set conditions to design the roll clearance adjusting device 4 independently of the release device.

Further, the sheet-material releasing function can be very readily generated only by using the control device 24 (FIG. 4) to control supply and discharge of an air to the cylinder 25.

Embodiments 2 to 6 of the invention will be described below. In addition, the same elements and members as those in Embodiment 1 are denoted by the same reference numerals in FIGS. 8 to 16, in which Embodiments 2 to 6 are shown. A detailed explanation of the same parts as those in Embodiment 1 is omitted in the following descriptions.

Embodiment 2

Figure 8:
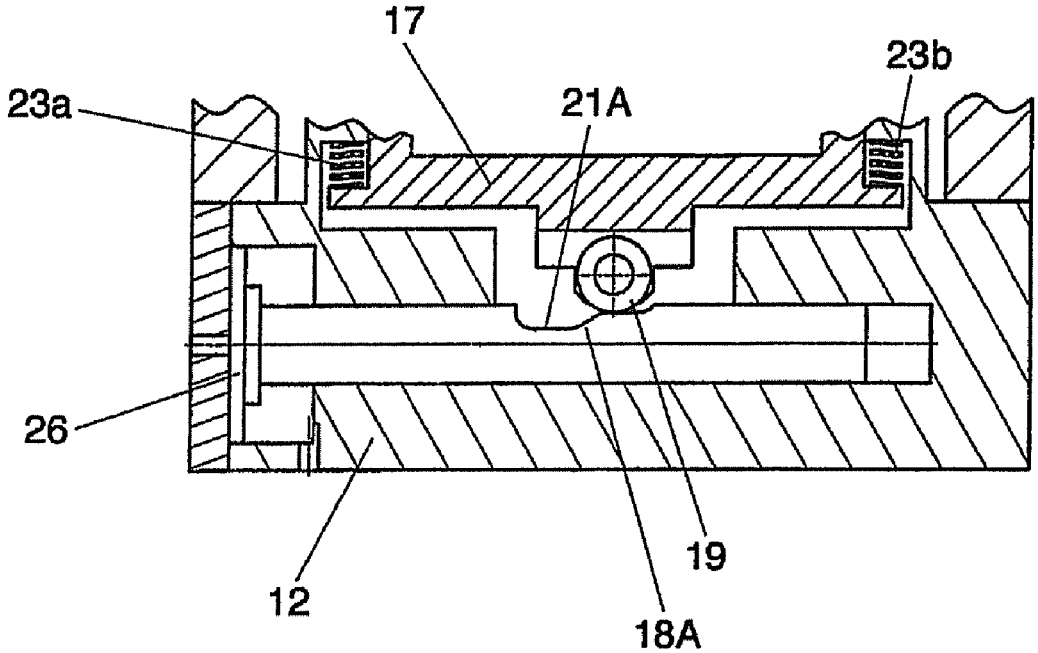
FIG. 8 is a cross sectional view showing Embodiment 2 of the invention.

Embodiment 2 shown in FIG. 8 comprises a single cam surface 21A formed on a rectilinear cam 18A and a single cam follower 19 engages with the cam surface 21A. With such construction, it is possible to maintain a sub-roll in a not-completely horizontal state. Accordingly, even in the case where, for example, a sheet material is delicately different in thickness between one end and the other end of a sheet width, sheet feeding in a state, in which the sub-roll is inclined, is made possible according to the difference.

Embodiment 3

Figure 9:
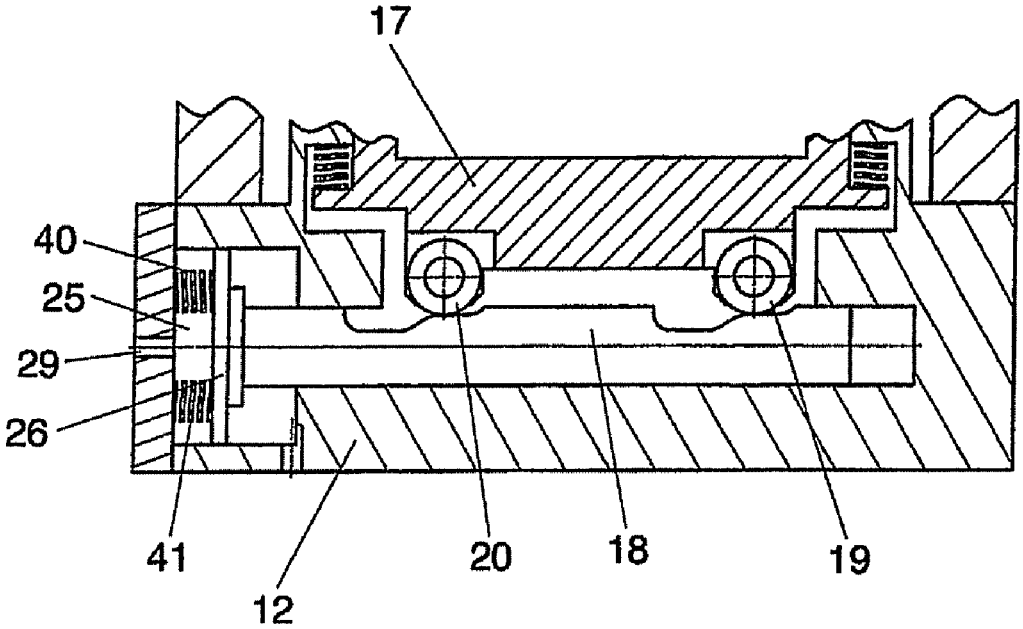
FIG. 9 is a cross sectional view showing Embodiment 3 of the invention.

According to Embodiment 3 shown in FIG. 9, elastic members 40, 41 are provided in a cylinder 25. The elastic members 40, 41 are put in a compressed state when a rectilinear cam 18 is in a position shown in FIG. 9, that is, a sub-roll is displaced upward through the medium of cam followers 19, 20 and a sub-roll guide 17 to interpose a sheet material between a main roll and the sub-roll. Accordingly, at the time of sheet-material release, at which time the rectilinear cam 18 moves rightward from a position shown in FIG. 9 to displace the sub-roll downward, movement of the rectilinear cam 18 and hence downward displacement of the sub-roll can be made further quickly since elastic forces of the elastic members 40, 41 in addition to air pressure introduced into a cylinder 25 through a first port 29 promote movements of the rectilinear cam 18.

Embodiment 4

Figure 10:
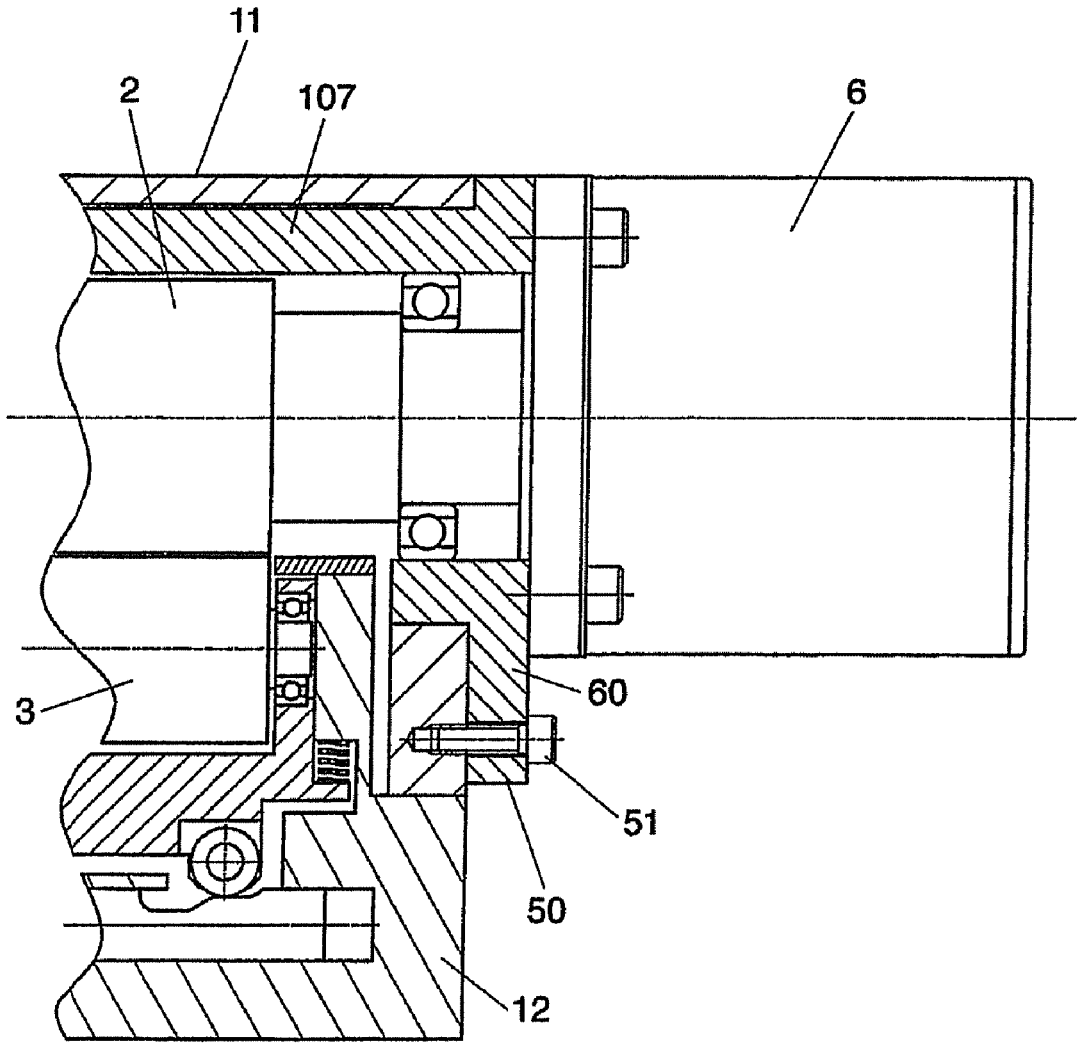
FIG. 10 is a cross sectional view showing Embodiment 4 of the invention.
Figure 11:
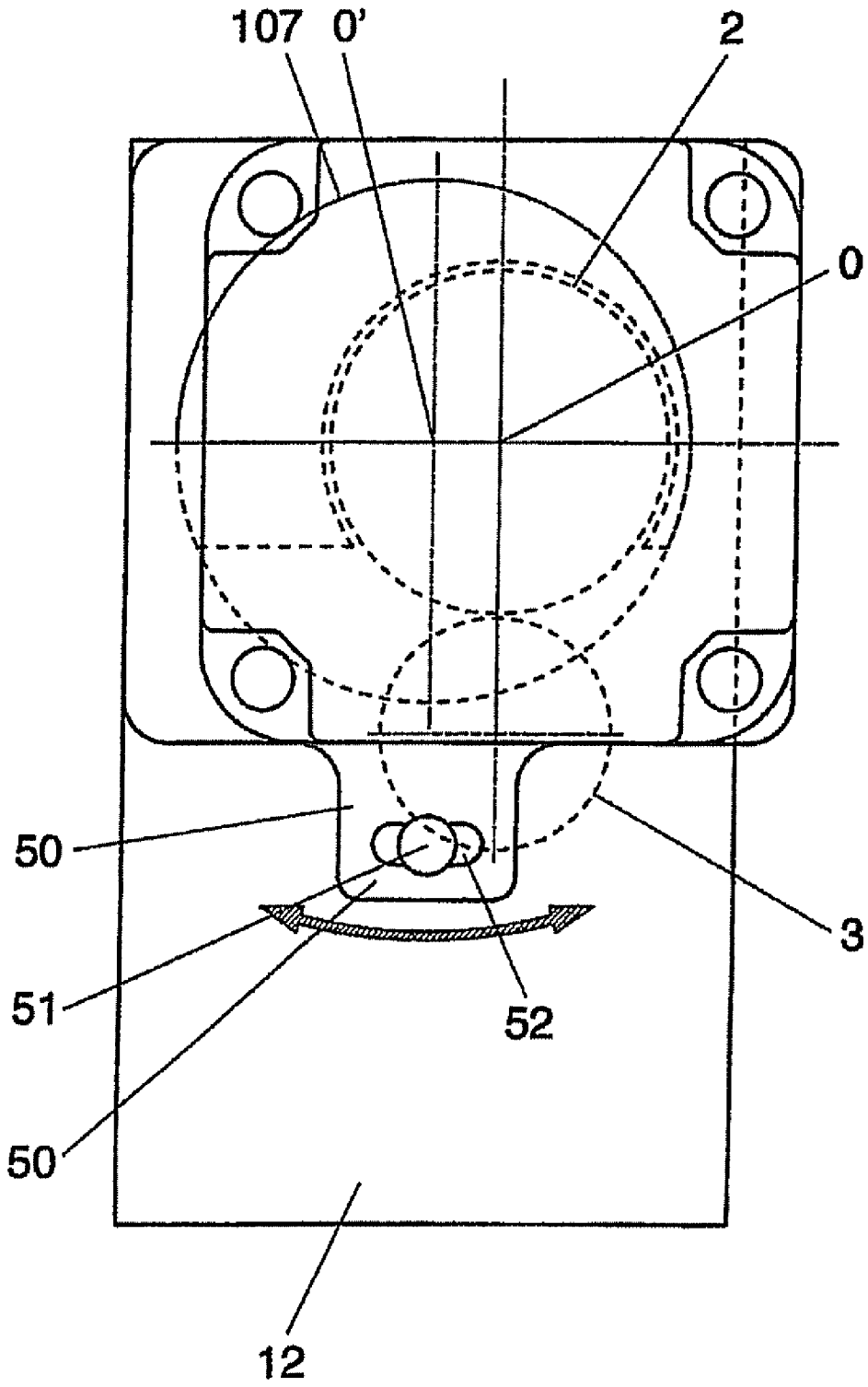
FIG. 11 is a right side view of FIG. 10.
Figure 12A:
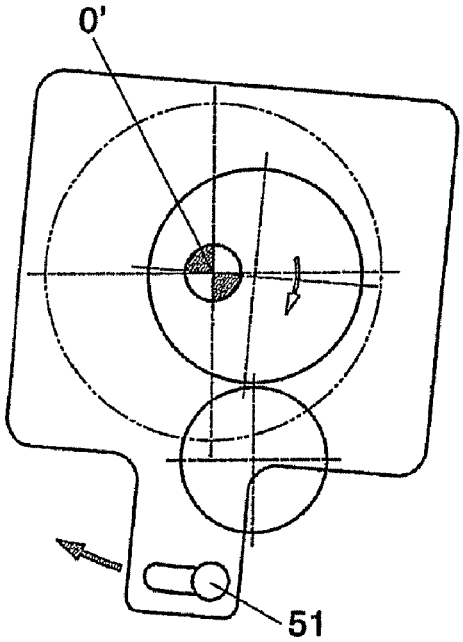
FIGS. 12A and 12B are views illustrating a state, in which an eccentric flange is rotated in Embodiment 4.
Figure 12B:
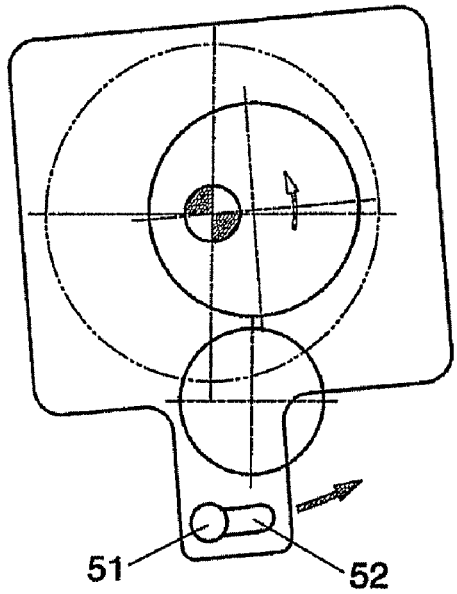

According to Embodiment 4 shown in FIGS. 10 and 11, an operating part, that is, a projection 50 for rotational operation of an eccentric flange 107 is provided on an end member 60 at one axial end of an eccentric flange 107. Formed on the projection 50 is an arcuate groove 52 centered on an eccentric axis O of the eccentric flange 107. In adjusting a roll clearance, the projection 50 is manually or mechanically grasped and the eccentric flange 107 is rotated. That is, it suffices to rotate the eccentric flange 107 by an appropriate magnitude in a direction, in which a roll clearance is decreased as shown in FIG. 12A, or in a direction, in which a roll clearance is increased as shown in FIG. 12B, and to fix the projection 50 to a housing by means of a bolt 51.

Embodiment 5

Figure 13:
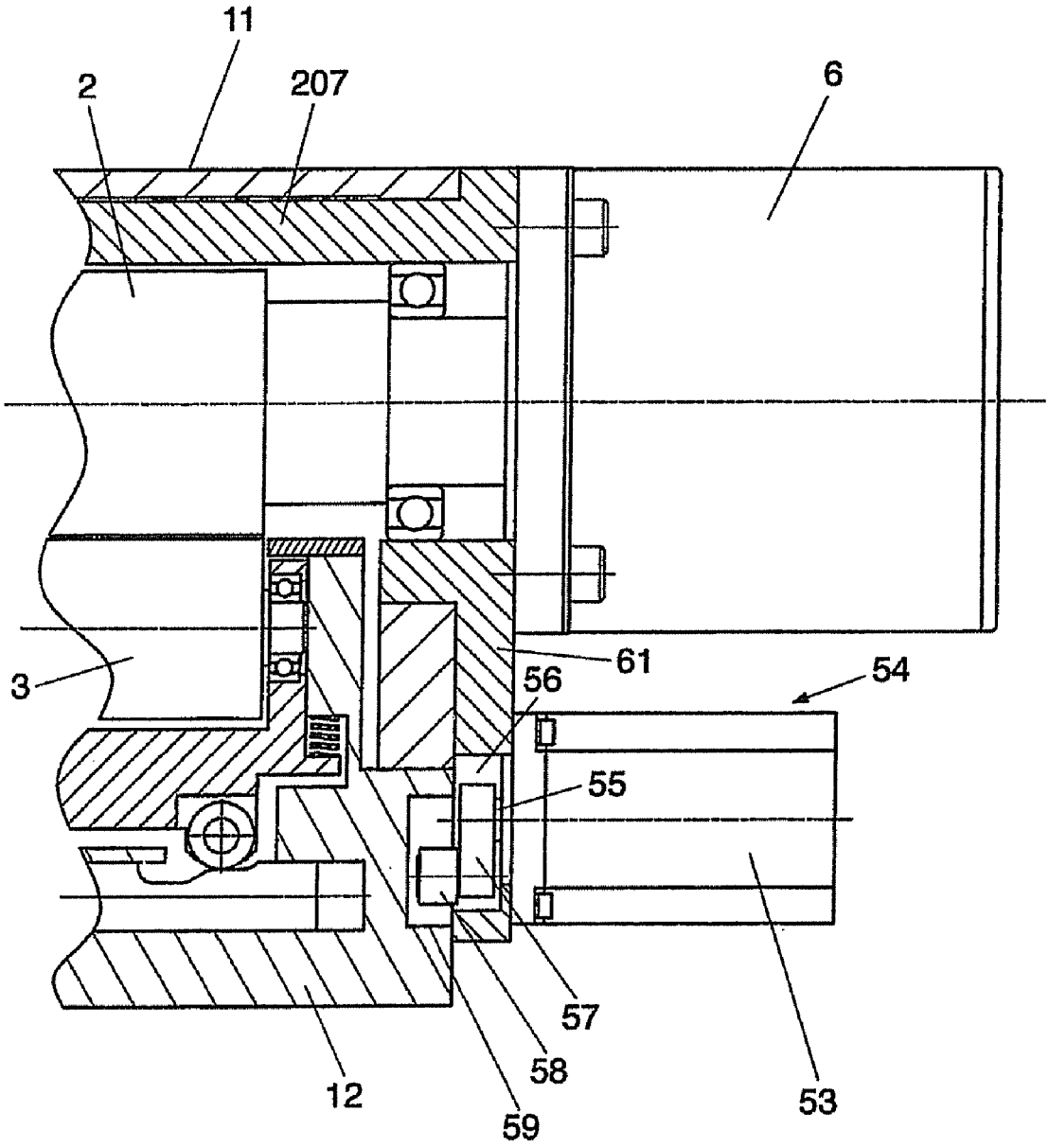
FIG. 13 is a cross sectional view showing Embodiment 5 of the invention.
Figure 14:
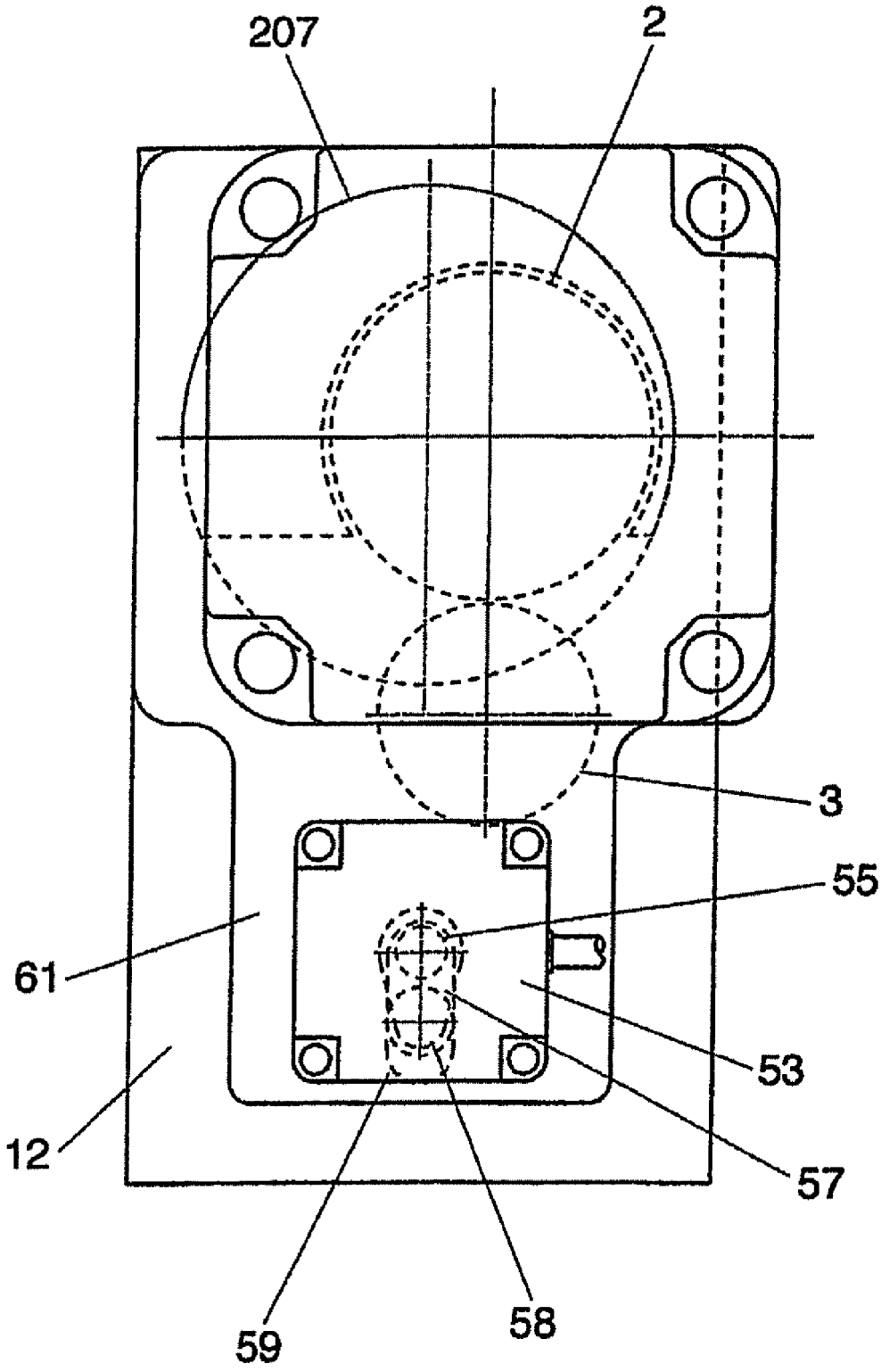
FIG. 14 is a right side view of FIG. 13.

According to Embodiment 5 shown in FIGS. 13 and 14, there is provided an eccentric-flange driving device 54 for rotational driving of an eccentric flange 207. The eccentric-flange driving device 54 includes an eccentric-flange drive motor 53 mounted on an end member 61 at one axial end of the eccentric flange 207 and a swinging arm 57 mounted to a motor shaft 55 of the eccentric-flange drive motor 53 and provided in a recess 56 on a wall portion of the end member 61 of the eccentric flange 207. A roller follower 58 is protrusively provided at a tip end of the swinging arm 57 to be able to roll, the roller follower 58 engaging with a guide groove 59 provided on a wall portion of a housing of a sheet material feeding apparatus, that is, a second housing portion 12 in the embodiment shown in the figure.

Figure 15C:
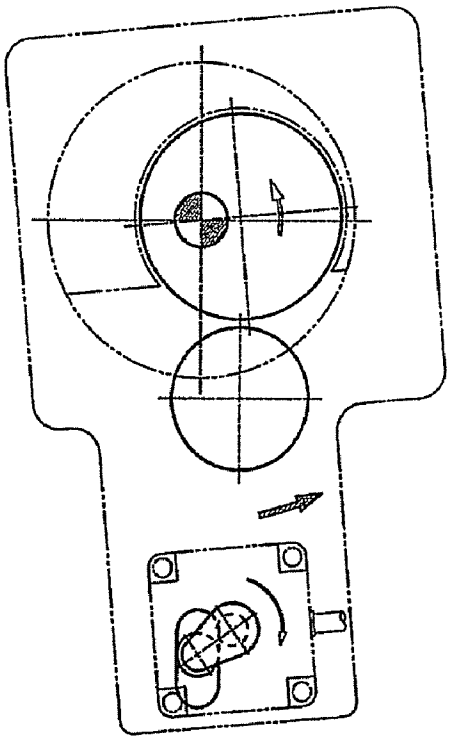
FIGS. 15A, 15B, and 15C are views illustrating the operation of a roll clearance adjusting device in Embodiment 5.
Figure 15A:
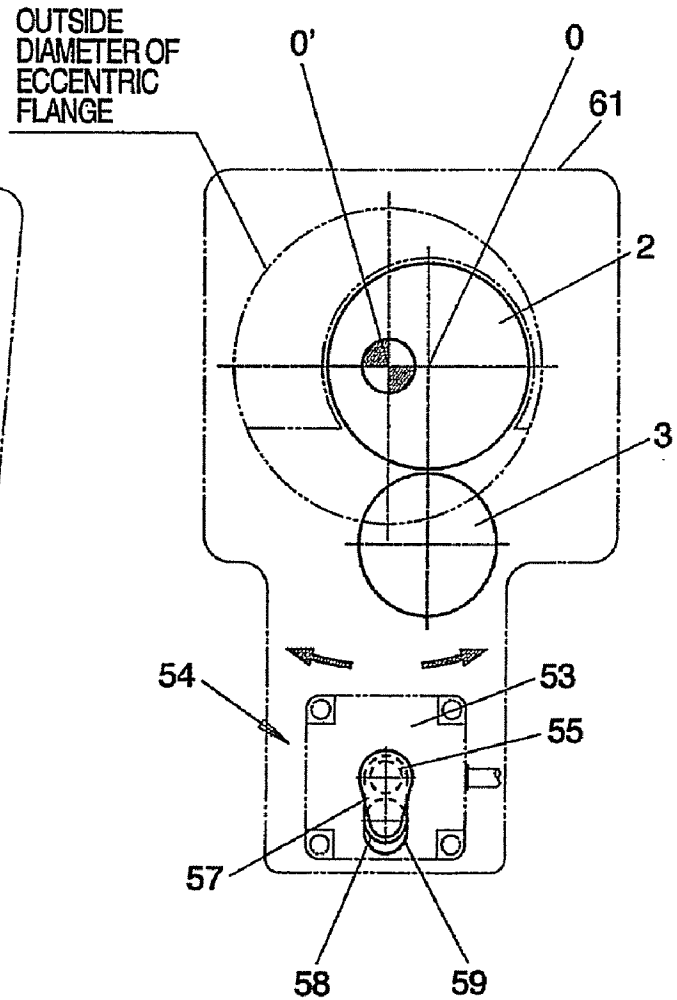
Figure 15B:
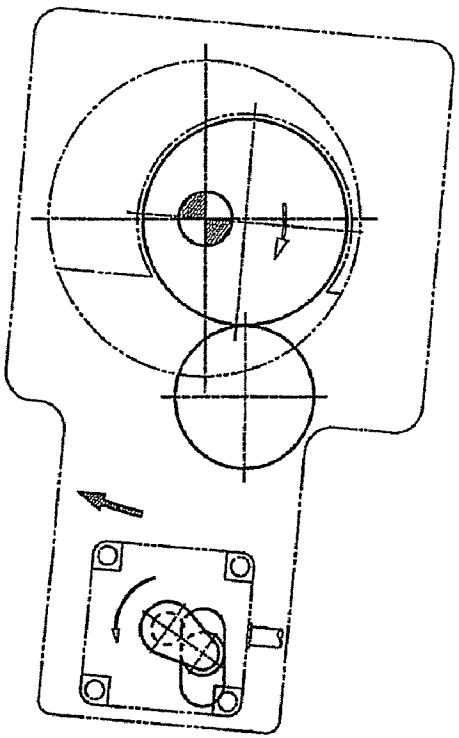

According to Embodiment 5, when the motor shaft 55 of the eccentric-flange drive motor 53 is rotationally driven from a state shown in FIG. 15A to swing the swinging arm 57, the roller follower 58 moves up and down in the guide groove 59 while rolling and the swinging arm 57 correspondingly swings together with the motor shaft 55 to rotate the eccentric flange 207 in a direction, in which a roll clearance is decreased as shown in FIG. 15B, or in a direction, in which a roll clearance is increased as shown in FIG. 15C.

Embodiment 6

Figure 16B:
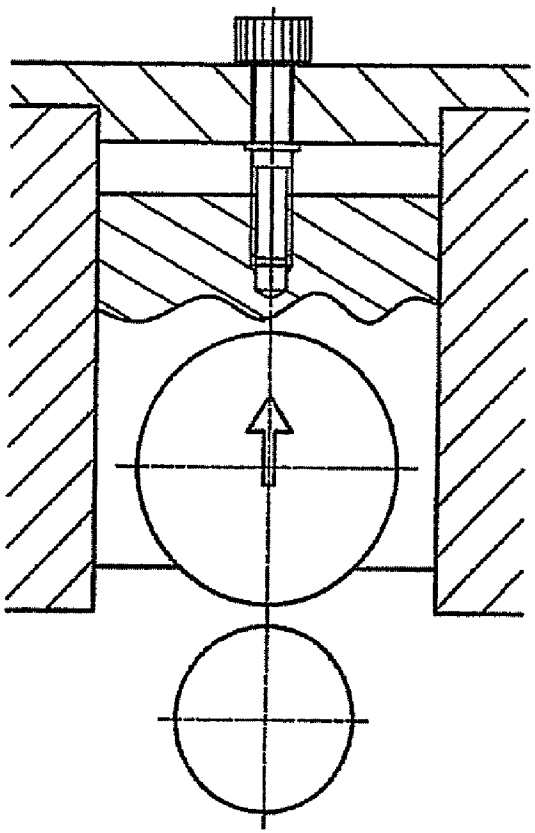
FIGS. 16A and 16B are cross sectional views showing Embodiment 6 of the invention.
Figure 16A:
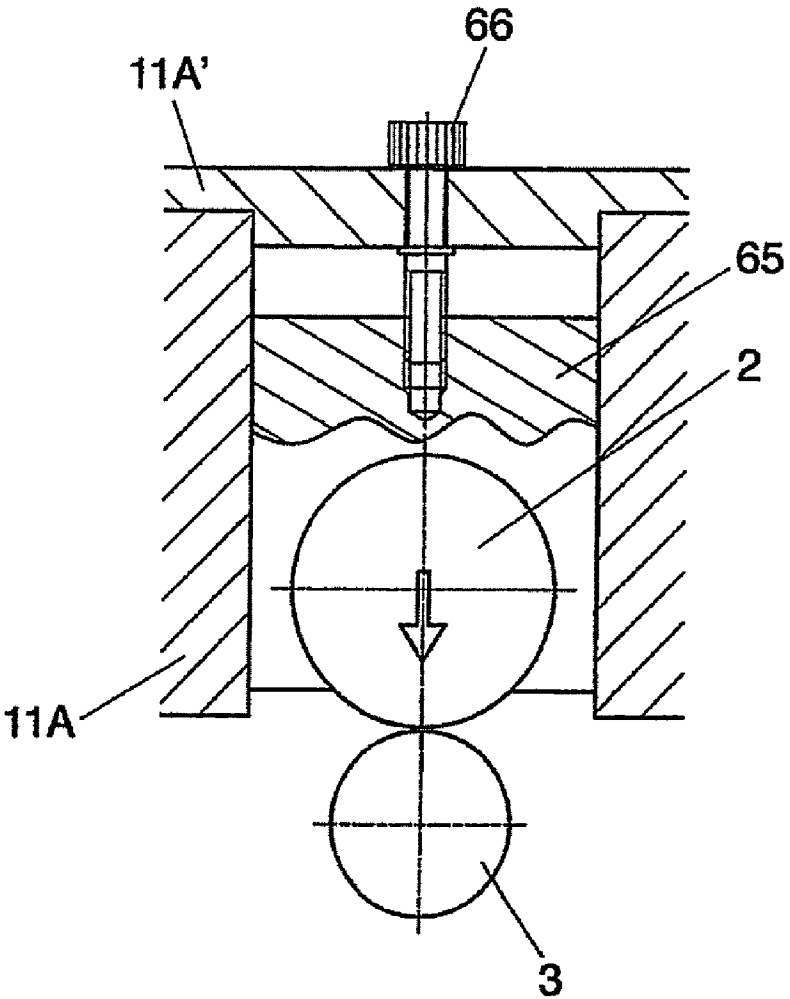

According to Embodiment 6 shown in FIG. 16, a roll clearance is adjusted without the use of any eccentric flange. That is, according to Embodiment 6, a main roll 2 is held by a holding member 65 provided vertically slidably on a housing 11A and an adjustment bolt 66 extending through a top wall 11A' of the housing to be threaded into the holding member 65 is rotated whereby the main roll 2 together with the holding member 65 is displaced downward as shown in FIG. 16A, or displaced upward as shown in FIG. 16B to adjust a roll clearance according to the thickness of a sheet material.

The invention claimed is:

1. A sheet material feeding apparatus comprising:

a pair of rolls that interpose therebetween a sheet material to intermittently feed the same to a press apparatus;

a roll clearance adjusting device that adjusts a clearance between the pair of rolls according to the thickness of the sheet material; and a release device that temporarily releases the sheet material having been interposed by the pair of rolls just before the sheet material fed to the press apparatus is subjected to press working, and wherein:

the pair of rolls comprise a main roll driven by a drive motor and a sub-roll driven through the sheet material by the main roll, the roll clearance adjusting device displaces the main roll up and down to adjust a clearance between the main roll and the sub-roll, the release device includes a sub-roll guide that rotatably supports the sub-roll and that moves up and down together with the sub-roll, a rectilinear cam that is movable in a direction parallel to a longitudinal axis of the sub-roll and having an upper surface with a cam surface, a cam follower mounted to the sub-roll guide and that is supported for rotation about an axis that is substantially perpendicular to the longitudinal axis of the sub-roll to engage with the cam surface of the rectilinear cam, and a control device that moves the rectilinear cam in the direction parallel to the longitudinal axis of the sub-roll in synchronism with the operation of the press apparatus to displace the sub-roll up and down through the cam follower and the sub-roll guide, the cam surface having a shape for displacing, via the cam follower and the sub-roll guide, the sub-roll between an upper position and a lower position according to movement of the rectilinear cam in the direction parallel to the longitudinal axis of the sub-roll, and the cam surface having an upwardly raised portion extending substantially parallel to the longitudinal axis of the sub-roll for positioning the sub-roll at the upper position and a downwardly recessed portion for positioning the sub-roll at the lower position.

2. The sheet material feeding apparatus according to claim 1, wherein the control device includes a cylinder, a piston accommodated in the cylinder to be able to reciprocate and connected to the rectilinear cam, and means that controls supply and discharge of air from the cylinder.

3. The sheet material feeding apparatus according to claim 1, wherein the roll clearance adjusting device comprises an eccentric flange mounted rotatably in a housing of the sheet material feeding apparatus and including a cylindrical-shaped, outer peripheral surface centered on an eccentric axis off-centered relative to an axis of the main roll and a cylindrical-shaped, inner peripheral surface in a coaxial relationship with the axis of the main roll, the main roll having at least one axial end that is mounted rotatably in the housing with the eccentric flange therebetween, and the main roll is displaced up and down by rotating the eccentric flange relative to the housing about the eccentric axis.

4. The sheet material feeding apparatus according to claim 3, wherein the eccentric flange includes an operating part for rotational operation of the eccentric flange.

5. The sheet material feeding apparatus according to claim 3, wherein an eccentric-flange driving device for rotational driving of the eccentric flange is provided on the eccentric flange.

6. The sheet material feeding apparatus according to claim 1, wherein the sub-roll guide is biased away from the main roll guide by at least one biasing member.

7. The sheet material feeding apparatus according to claim 1, further comprising a housing portion that defines a cam pocket that receives the rectilinear cam for sliding movement therein along the direction parallel to the longitudinal axis of the sub-roll, the cam pocket including an inner surface that is operable to limit movement of the rectilinear cam in a direction transverse to the longitudinal axis of the sub-roll.

8. The sheet material feeding apparatus according to claim 7, wherein the inner surface comprises an upper inner surface and a lower inner surface, the upper inner surface operable to limit movement of the rectilinear cam substantially perpendicular to the longitudinal axis of the sub-roll toward the sub-roll, and the lower inner surface operable to limit movement of the rectilinear cam substantially perpendicular to the longitudinal axis of the sub-roll away from the sub-roll.

9. A sheet material feeding apparatus comprising:

a pair of rolls that interpose therebetween a sheet material to intermittently feed the same to a press apparatus;

a roll clearance adjusting device that adjusts a clearance between the pair of rolls according to the thickness of the sheet material; and a release device that temporarily releases the sheet material having been interposed by the pair of rolls just before the sheet material fed to the press apparatus is subjected to press working, and wherein:

the pair of rolls comprise a main roll driven by a drive motor and a sub-roll driven through the sheet material by the main roll, the roll clearance adjusting device displaces the main roll up and down to adjust a clearance between the main roll and the sub-roll, the release device includes a sub-roll guide that rotatably supports the sub-roll and that moves up and down together with the sub-roll, a rectilinear cam that is movable axially of the sub-roll, a cam follower mounted to the sub-roll guide to engage with a cam surface of the rectilinear cam, and a control device that moves the rectilinear cam in synchronism with the operation of the press apparatus to displace the sub-roll up and down through the cam follower and the sub-roll guide, the roll clearance adjusting device comprises an eccentric flange mounted rotatably in a housing of the sheet material feeding apparatus and including a cylindrical-shaped, outer peripheral surface centered on an eccentric axis off-centered relative to an axis of the main roll and a cylindrical-shaped, inner peripheral surface in a coaxial relationship with the axis of the main roll, the main roll having a plurality of axial ends that are mounted rotatably in the housing with the eccentric flange therebetween, and the main roll is displaced up and down by rotating the eccentric flange relative to the housing about the eccentric axis, and the drive motor is fixed to one axial end of the eccentric flange to be able to rotate together with the eccentric flange, and a motor shaft of the drive motor is connected to one end of the main roll.

10. A sheet material feeding apparatus comprising:

a pair of rolls that interpose therebetween a sheet material to intermittently feed the same to a press apparatus;

a roll clearance adjusting device that adjusts a clearance between the pair of rolls according to the thickness of the sheet material; and a release device that temporarily releases the sheet material having been interposed by the pair of rolls just before the sheet material fed to the press apparatus is subjected to press working, and wherein:

the pair of rolls comprise a main roll driven by a drive motor and a sub-roll driven through the sheet material by the main roll, the roll clearance adjusting device displaces the main roll up and down to adjust a clearance between the main roll and the sub-roll, the release device includes a sub-roll guide that rotatably supports the sub-roll and that moves up and down together with the sub-roll, a rectilinear cam that is movable in a direction parallel to a longitudinal axis of the sub-roll and having an upper surface with a cam surface, a cam follower mounted to the sub-roll guide to engage with the cam surface of the rectilinear cam, and a control device that moves the rectilinear cam in the direction parallel to the longitudinal axis of the sub-roll in synchronism with the operation of the press apparatus to displace the sub-roll up and down through the cam follower and the sub-roll guide, the cam surface has a shape for displacing, via the cam follower and the sub-roll guide, the sub-roll between an upper position and a lower position according to movement of the rectilinear cam in the direction parallel to the longitudinal axis of the sub-roll, the cam surface has an upwardly raised portion extending substantially parallel to the longitudinal axis of the sub-roll for positioning the sub-roll at the upper position and a downwardly recessed portion for positioning the sub-roll at the lower position, the roll clearance adjusting device comprises an eccentric flange mounted rotatably in a housing of the sheet material feeding apparatus and including a cylindrical-shaped, outer peripheral surface centered on an eccentric axis off-centered relative to an axis of the main roll and a cylindrical-shaped, inner peripheral surface in a coaxial relationship with the axis of the main roll, the main roll having at least one axial end that is mounted rotatably in the housing with the eccentric flange therebetween, and the main roll is displaced up and down by rotating the eccentric flange relative to the housing about the eccentric axis, an eccentric-flange driving device for rotational driving of the eccentric flange is provided on the eccentric flange, and the eccentric-flange driving device includes an eccentric-flange drive motor mounted to one axial end of the eccentric flange, a swinging arm mounted to a motor shaft of the eccentric-flange drive motor and provided in a recess on a wall portion of the eccentric flange, and a roller follower provided protrusively at a tip end of the swinging arm to engage with a guide groove provided on a wall portion of the housing of the sheet material feeding apparatus, and when the motor shaft of the eccentric-flange drive motor is rotationally driven to swing the swinging arm, the eccentric flange is rotated through the roller follower and the guide groove.

* * * * *